US011220952B1

(12) United States Patent
Ayva et al.

(10) Patent No.: US 11,220,952 B1
(45) Date of Patent: Jan. 11, 2022

(54) HYDRAULIC ISOLATION OF COOLING CIRCUITS WITH DEGAS BOTTLE FOR COMMON FILLING

(71) Applicant: Ford Global Technologies, LLC, Dearborn, MI (US)

(72) Inventors: Mursel Ayva, Essex (GB); Cliff Pountney, Essex (GB)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/018,186

(22) Filed: Sep. 11, 2020

(51) Int. Cl.

| | |
|---|---|
| ***F01P 11/02*** | (2006.01) |
| ***F01P 7/16*** | (2006.01) |
| ***F01P 11/00*** | (2006.01) |
| ***F01P 7/14*** | (2006.01) |

(52) U.S. Cl.
CPC ..... *F01P 11/0285* (2013.01); *F01P 7/14* (2013.01); *F01P 11/0204* (2013.01); *F01P 11/029* (2013.01)

(58) Field of Classification Search
CPC .... F01P 11/029; F01P 7/165; F01P 2007/146; F01P 11/18; F01P 11/028; F01P 11/02
See application file for complete search history.

(56) References Cited

U.S. PATENT DOCUMENTS

| | | | | |
|---|---|---|---|---|
| 5,329,889 | A * | 7/1994 | Caldwell | F01P 11/029 123/41.54 |
| 6,216,646 | B1 * | 4/2001 | Smith | F01P 11/029 123/41.54 |
| 8,356,724 | B2 | 1/2013 | Kardos et al. | |
| 8,857,480 | B2 | 10/2014 | Sullivan et al. | |
| 2011/0073597 | A1 * | 3/2011 | Hutchins | B01D 19/0036 220/203.01 |
| 2016/0208678 | A1 * | 7/2016 | Zhang | F01P 11/029 |
| 2017/0145962 | A1 * | 5/2017 | Dudar | F01P 11/028 |
| 2018/0100709 | A1 * | 4/2018 | Gopal | F01M 5/005 |
| 2020/0009939 | A1 * | 1/2020 | Potticary | B60H 1/00571 |

FOREIGN PATENT DOCUMENTS

| | | | |
|---|---|---|---|
| CN | 206600198 | U | 1/2017 |
| DE | 102017004632 | A1 | 11/2017 |

* cited by examiner

*Primary Examiner* — Long T Tran
(74) *Attorney, Agent, or Firm* — Burr & Forman, LLP

(57) ABSTRACT

A vehicle cooling system includes a first cooling circuit having a first operating temperature range when the vehicle is in an operational state, a second cooling circuit having a second operating temperature range, and a degas bottle. The degas bottle has a first chamber operably coupled to the first cooling circuit and a second chamber operably coupled to the second cooling circuit. The degas bottle includes a first chamber operably coupled to the first cooling circuit, a second chamber operably coupled to the second cooling circuit, and a third chamber configured as a common filling chamber for the first and second chambers. The first chamber is operably coupled to the third chamber via a first filling gate, and the second chamber is operably coupled to the third chamber via a second filling gate. The first and second filling gates are configured for simultaneous opening during a fill operation in which cooling fluid is provided into the third chamber to fill the first and second chambers.

20 Claims, 5 Drawing Sheets

HYDRAULIC ISOLATION OF COOLING CIRCUITS WITH DEGAS BOTTLE FOR COMMON FILLING

TECHNICAL FIELD

Example embodiments generally relate to vehicle cooling circuits and, more particularly, relate to a way to simultaneously fill two vehicle cooling circuits having different operating temperatures with cooling fluid while still keeping the circuits thermally isolated.

BACKGROUND

In automotive applications, a number of cooling circuits may be employed in order to cool various vehicle components. In some cases, individual components or component systems may have corresponding individual cooling circuits. As an example, a hybrid vehicle may include a main engine cooling circuit that may provide cooling to the main engine, along with two corresponding cooling circuits associated with providing cooling for the battery and the inverter unit, respectively. Each of these cooling circuits may operate and therefore also be maintained independently from one another. In particular, even though the inverter cooling circuit and the battery cooling circuit may use the same cooling fluid, they may nevertheless be maintained separate from each other due to the fact that the two circuits operate in different temperature ranges since operating temperature limits of the battery and the inverter are usually significantly different.

As a result of the isolation of these cooling circuits, additional service requirements are created and the complexity associated with conducting vehicle maintenance is increased. In this regard, each of the three cooling circuits mentioned above would typically have an independent filling process for the replacement or replenishment of cooling fluid. Moreover, each individual cooling circuit would also generally have a corresponding separate filling port at which the filling process could be undertaken. Cooling fluid is therefore added to three separate filling ports in three entirely separate actions.

Thus, it may be desirable to develop an alternative strategy for designing cooling circuit filling ports. In this regard, the provision of a structure or way by which to fill more than one thermally isolated cooling circuit using a single filling port may be desirable.

BRIEF SUMMARY OF SOME EXAMPLES

In accordance with an example embodiment, a vehicle cooling system may be provided. The vehicle cooling system may include a first cooling circuit having a first operating temperature range when the vehicle is in an operational state, a second cooling circuit having a second operating temperature range, and a degas bottle. The degas bottle has a first chamber operably coupled to the first cooling circuit and a second chamber operably coupled to the second cooling circuit. The degas bottle includes a first chamber operably coupled to the first cooling circuit, a second chamber operably coupled to the second cooling circuit, and a third chamber configured as a common filling chamber for the first and second chambers. The first chamber is operably coupled to the third chamber via a first filling gate, and the second chamber is operably coupled to the third chamber via a second filling gate. The first and second filling gates are configured for simultaneous opening during a fill operation in which cooling fluid is provided into the third chamber to fill the first and second chambers.

In another example embodiment, a multi-chambered degas bottle for a vehicle cooling system is provided. The vehicle cooling system may include a first cooling circuit having a first operating temperature range when the vehicle is in an operational state, and a second cooling circuit having a second operating temperature range when the vehicle is in the operational state. The first operating temperature range may be higher than the second operating temperature range. The multi-circuit degas bottle may include a first chamber operably coupled to the first cooling circuit, a second chamber operably coupled to the second cooling circuit, and a third chamber configured as a common filling chamber for the first and second chambers. The first chamber is operably coupled to the third chamber via a first filling gate, and the second chamber is operably coupled to the third chamber via a second filling gate. The first and second filling gates are configured for simultaneous opening during a fill operation in which cooling fluid is provided into the third chamber to fill the first and second chambers.

In another example embodiment, a vehicle cooling system may be provided. The vehicle cooling system may include a first cooling circuit having a first operating temperature range when the vehicle is in an operational state, a second cooling circuit having a second operating temperature range, and a degas bottle. The degas bottle has a first chamber operably coupled to the first cooling circuit and a second chamber operably coupled to the second cooling circuit. The degas bottle includes a first chamber operably coupled to the first cooling circuit, a second chamber operably coupled to the second cooling circuit, and a third chamber configured as a common filling chamber for the first and second chambers. The first chamber is operably coupled to the third chamber via a first filling gate, and the second chamber is operably coupled to the third chamber via a second filling gate. The first and second filling gates are biased to a closed position such that the third chamber empties into the first and second chambers during a fill operation and remains substantially empty of cooling fluid in the operational state when a fill level for the cooling fluid in each of the first and second chambers higher than a bottom wall of the third chamber.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
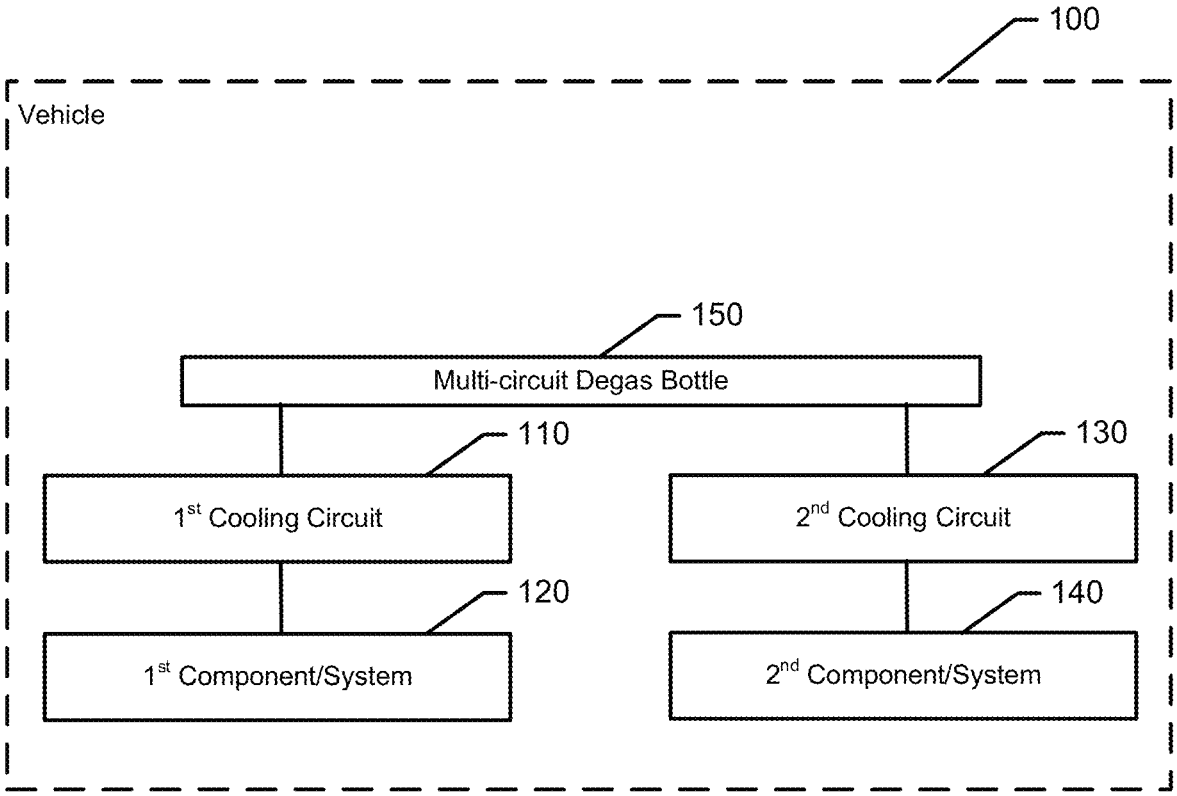
FIG. 1 illustrates a block diagram of a vehicle cooling system in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments described herein provide an improved design for enabling at least two cooling circuits to be filled with cooling fluid (e.g., automotive coolant) via a common filling port. In this regard, the common filling port may be provided as part of a multi-chambered degas bottle. The common filling port may be operably coupled to a dry filling chamber that is shared between (at least) two cooling circuits that are otherwise thermally isolated. The challenge of maintaining the thermal isolation (e.g., reducing unwanted exchange of coolant between systems, and reducing conduction of heat between systems) while still permitting both cooling circuits to be filled by one filling port is met by virtue of the design elements and structures described herein, which are exemplary of one way of employing an example embodiment. As a result, cost savings may be achieved by reducing overall component counts, and the complexity and time requirements associated with vehicle maintenance may be reduced.

FIG. 1 illustrates a block diagram of cooling circuits of a vehicle 100 of an example embodiment. As shown in FIG. 1, the vehicle 100 may include a first cooling circuit 110 and a second cooling circuit 120. However, as noted above, the vehicle 100 may include additional cooling circuits as well. Thus, although an example embodiment is described herein to show how two cooling circuits of the vehicle 100 are capable of being filled using a single filling port, it should be appreciated that the design elements described herein could be extended to operation with yet further cooling circuits of the vehicle 100 as well.

The first cooling circuit 110 may be operably coupled to a corresponding first component or system 120, and the second cooling circuit 130 may be operably coupled to a corresponding second component or system 140. The first component or system 120 of this example may be a component or system that operates at a relatively high temperature or generates a relatively large heat load (as compared to the second component or system 140). Meanwhile, the second component or system 140 may be a component or system that operates at a relatively low temperature or generates a relatively smaller heat load (as compared to the first component or system 120). In an example embodiment, the first component or system 120 may be an inverter assembly of the vehicle 100, and the second component or system 140 may be a battery unit of the vehicle 100. Accordingly, the first cooling circuit 110 may be considered to be a high temperature circuit, and the second cooling circuit 130 may be considered to be a low temperature cooling circuit.

The first cooling circuit 110 may include one or more heat exchangers or other heat transfer components that are configured to transfer heat from the first component or system 120 to cooling fluid of the first cooling circuit 110. The first cooling circuit 110 may then be further configured to enable the cooling fluid to transfer heat out of the first cooling circuit 110 (e.g., via a heat sink or other heat transfer interfaces). The cooling fluid may be moved within the first cooling circuit 110 via a pump, thermal driving head created within the system, or other methods of providing movement of the cooling fluid. Similarly, the second cooling circuit 130 may include one or more heat exchangers or other heat transfer components that are configured to transfer heat from the second component or system 140 to cooling fluid of the second cooling circuit 130. The second cooling circuit 130, which may move the cooling fluid within the second cooling circuit 130 similar to the way the cooling fluid is moved within the first cooling circuit 110, may then be further configured to enable the cooling fluid to transfer heat out of the second cooling circuit 130 (e.g., via a heat sink or other heat transfer interfaces).

The cooling fluid used in each of the first cooling circuit 110 and the second cooling circuit 130 may be the same type of automotive coolant. Thus, one thought for simplifying maintenance requirements may be to simply connect the first and second cooling circuits 110 and 130 together either through integration of the circuits, or through just using a common filling point for both circuits. Doing so would provide for sharing of the same cooling fluid within the combined system. However, as noted above, due to the different operating temperatures of the first component or system 120 and the second component or system 140, hydraulically linking the first and second cooling circuits 110 and 130 could cause dramatic impacts on respective ones of the circuits when the other circuit is experiencing a significant temperature change. These impacts may lead to significant performance degradation, and therefore should be avoided.

To provide for the advantage of enabling a single filling port to serve the first and second cooling circuits 110 and 130 without compromising the thermal isolation between the first and second cooling circuits 110 and 130, some example embodiments may provide a multi-circuit degas bottle or multi-chambered degas bottle 150 (referring to hereinafter simply as degas bottle 150). Degas bottles are commonly used in automotive engine coolant systems to de-aerate the cooling fluid while the cooling fluid operates within the corresponding cooling circuit. In conventional systems, each individual cooling circuit would be expected to have its own respective degas bottle, which typically also includes a filling port (e.g., with a corresponding cap). However, example embodiments may include the degas bottle 150 having the design elements and features described herein to enable one instance of a degas bottle to serve two or more otherwise thermally isolated cooling circuits to enable simultaneous cooling fluid filling or replenishment.

Figure 2:
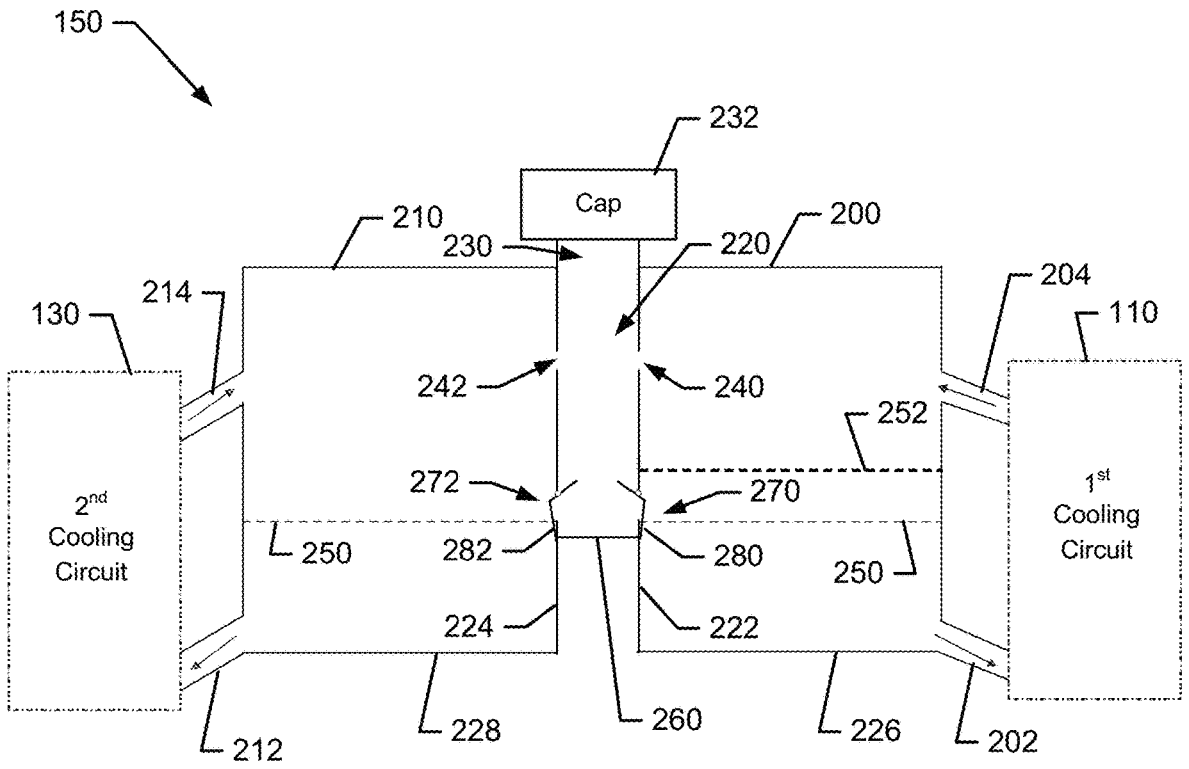
FIG. 2 illustrates a concept view of a multi-chambered degas bottle in accordance with an example embodiment.

FIG. 2 illustrates a concept view of the degas bottle 150 of an example embodiment while the degas bottle 150 is in an operational state and therefore filled. In this regard, as shown in FIG. 2, the degas bottle 150 may include a first chamber 200 that is operably coupled to the first cooling circuit 110 via an inlet line 202 and an outlet line 204. The first chamber 200 may be a single compartment or, in some cases, may include sub-chambers. The degas bottle 150 may also include a second chamber 210 operably coupled to the second cooling circuit 130 via an inlet line 212 and an outlet line 214. The second chamber 210 may also either be a single compartment or include sub-chambers.

In an example embodiment, the first and second chambers 200 and 210 of the degas bottle 150 may be separated from each other by a filling chamber 220, which may form a distinct (e.g., third) chamber from the first and second chambers 200 and 210. The filling chamber 220 may be referred to as a "dry filling chamber" since the filling chamber 220 may be designed to remain substantially empty (i.e., having allowed most or all of the cooling fluid provided therein to pass into the first and second chambers 200 and 210) or "dry." In some cases, the filling chamber 220 may retain less than 5% of its capacity when considered empty or dry. The first chamber 200 may be separated from the filling chamber 220 by a first isolation wall 222, and the second chamber 210 may be separated from the filling chamber 220 by a second isolation wall 224. As can be appreciated from FIG. 2, the first and second isolation walls 222 and 224 may be spaced apart from each other by the diameter of the filling chamber 220. Moreover, in some cases, the first and second isolation walls 222 and 224 may extend substantially parallel to each other.

The first and second chambers 200 and 210 may also include respective bottom walls 226 and 228. The bottom walls 226 and 228 are shown at the same level in FIG. 2, and the first and second chambers 200 and 210 are generally shown to be of similar size. However, it should be appreciated that the first and second chambers 200 and 210 could also be made to have different sizes. The increase in size of one of the first and second chambers 200 and 210 may be accomplished by changing the spacing of sidewalls of respective chambers, or by making the bottom wall 226 or 228 of one chamber deeper than the other.

The degas bottle 150 may further include a fill port 230 (or common fill port) formed at a top portion of the filling chamber 210. The fill port 230 may normally be sealed with a cap 232 as shown in FIG. 2. However, the cap 232 may be removed in order to allow filling of the degas bottle 150 via simultaneous filling of the first and second chambers 200 and 210 as described herein. Thus, for example, cooling fluid may be directly added to the filling chamber 220 via the fill port 230 (e.g., when the cap 232 is removed), and both the first chamber 200 and the second chamber 210 may be subsequently filled by passage of the cooling fluid from the filling chamber 220 to the first and second chambers 200 and 210. This addition of cooling fluid may typically occur when the vehicle 100 is in a non-operating or non-operational state.

The filling chamber 220 may insulate and isolate cooling fluid in the first chamber 200 from cooling fluid in the second chamber 210. However, in some cases, an air passage may be formed through the filling chamber 220 by virtue of the provision of air gates or vent holes (e.g., first air gate 240 and second air gate 242) in the first and second isolation walls 222 and 224, respectively, to connect the first and second chambers 200 and 210 to the filling chamber 220 (and to each other via the filling chamber 220). The air passage may therefore allow pressure equalization in each of the filling chamber 220 and the first and second chambers 200 and 210 via air moving between each respective chamber via the air passage.

The first and second air gates 240 and 242 may be formed at a portion of the first and second isolation walls 222 and 224, respectively, that is elevated with respect to (or spaced apart from) a bottom surface of the first and second chambers 200 and 210, respectively. Thus, to the extent that the cooling fluid is poured into the fill port 230 and reaches a level of the first and second air gates 240 and 242 within the fill chamber 220, the cooling fluid would be able to spill through the first air gate 240 into the first chamber 200, and spill through the second air gate 242 into the second chamber 210. Each of the first and second air gates 240 and 242 may be formed in the first and second isolation walls 222 and 224, respectively, at a level that is above a fill level 250 defined for the degas bottle 150 (and thereby defined for the first and second chambers 200 and 210) so that the level of the cooling fluid does not reach the first and second air gates 240 and 242 for normal or service filling in order to allow pressure in the first chamber 200 to escape to the second chamber 210 (and filling chamber 220). In some cases, high pressure may also escape out of the degas bottle 150 via the cap 232. Each of the first and second air gates 240 and 242 may also be formed in the first and second isolation walls 222 and 224, respectively, at a level that is above a maximum operating level 252 defined for the degas bottle 150 (e.g., for the hottest one of the first or second chamber 200 or 210 during operation) so that the level of the cooling fluid, after such level raises due to thermal expansion during operation, does not reach the first and second air gates 240 and 242.

In some examples, first and second isolation walls 222 and 224 may form opposing sidewalls of the filling chamber 220. Meanwhile a bottom wall 260 of the filling chamber 220 may be defined to extend between the first and second isolation walls 222 and 224. The bottom wall 260 of the filling chamber 220 may be at a higher elevation that both the bottom walls 226 and 228 of the first and second chambers 200 and 210, respectively. Moreover, the bottom wall 260 of the filling chamber 220 may be at an elevation or level that is relatively close to (although sometimes slightly below) the fill level 250 of the degas bottle 150 (and of the first and second chambers 200 and 210).

In order to ensure that relatively even filling of the first and second chambers 200 and 210 occurs once the cooling fluid is provided into the filling chamber 220, a first connection passage 270 may be provided into the first chamber 200 through the first isolation wall 222, and a second connection passage 272 may be provided in the second chamber 210 through the second isolation wall 224 at about the same elevation, and proximate to the bottom wall 260 of the filling chamber 260. A first filling gate 280 may be provided in association with the first connection passage 270, and a second filling gate 282 may be provided in association with the second connection passage 272. The fill level 250 may be proximate to (or directly at) the level at which the bottom of the first and second connection passages 270 and 272 is formed in the first and second isolation walls 222 and 224. When the cooling fluid is provided into the filling chamber 220, the first and second filling gates 280 and 282 may control the flow of the cooling fluid out of the filling chamber 220 and into the first and second chambers 200 and 210, prevent flow in the reverse direction, and ultimately achieve filling to the fill level 250.

In this regard, for example, the first and second filling gates 280 and 282 may each be hingedly attached to the first and second isolation walls 222 and 224. Moreover, in some cases, the first and second filling gates 280 and 282 may be biased to a closed position, which generally prevents from of fluid from the first and second chambers 200 and 210, respectively, to the filling chamber 220. As such, the first and second filling gates 280 and 282 may be configured to act similar to check valves, allowing flow from the filling chamber 220 into the first and second chambers 200 and 210, but preventing flow in the opposite direction. Although the first and second filling gates 280 and 282 may function as check valves, an off the shelf check valve may not be capable of performing in this system as desired. In this regard, the first and second filling gates 280 and 282, which may be structured as flaps, may be enabled to operate with larger openings formed by the first and second connection passages 270 and 272 than would be possible with a typical check valve, and yet achieve the desired function based on the dynamic responses to fluid conditions described herein. In some cases, the hinge via which the first and second filling gates 280 and 282 attach to the first and second isolation walls 222 and 224, respectively, may be disposed at a top portion of the first and second connection passages 270 and 272. Thus, the first and second filling gates 280 and 282 may each pivot about axes that are substantially parallel to each other and to the ground plane. This arrangement may enable the first and second filling gates 280 and 282 to simply be constructed such that the weight of the first and second filling gates 280 and 282 biases them toward the closed position. However, when the cooling fluid begins to fill the filling chamber 220, a pressure may build up that overcomes the biasing of the first and second filling gates 280 and 282 to open them so that the cooling fluid can flow (e.g., simultaneously) into the first and second chambers 200 and 210. Generally, the first and second chambers 200 and 210 will fill at nearly equal rates and reach the fill level 250 at about the same time. However, if one of the first or second chambers 200 or 210 should happen to fill first, the pressure of fluid on the side of the corresponding (i.e., filled) one of the first or second chambers 200 or 210 will build and push the corresponding one of the first and second filling gates 280 or 282 closed. The other chamber may then fill until the same process closes other filling gate. As shown in FIG. 2, during operation, if the heating of the cooling fluid should cause the level of one of the chambers (e.g., the first chamber 200) to rise to the maximum operating level 252 (e.g., the expansion level), the first filling gate 280 will be retained in the closed position by the pressure exerted by the fluid in the first chamber 200.

Figure 3:
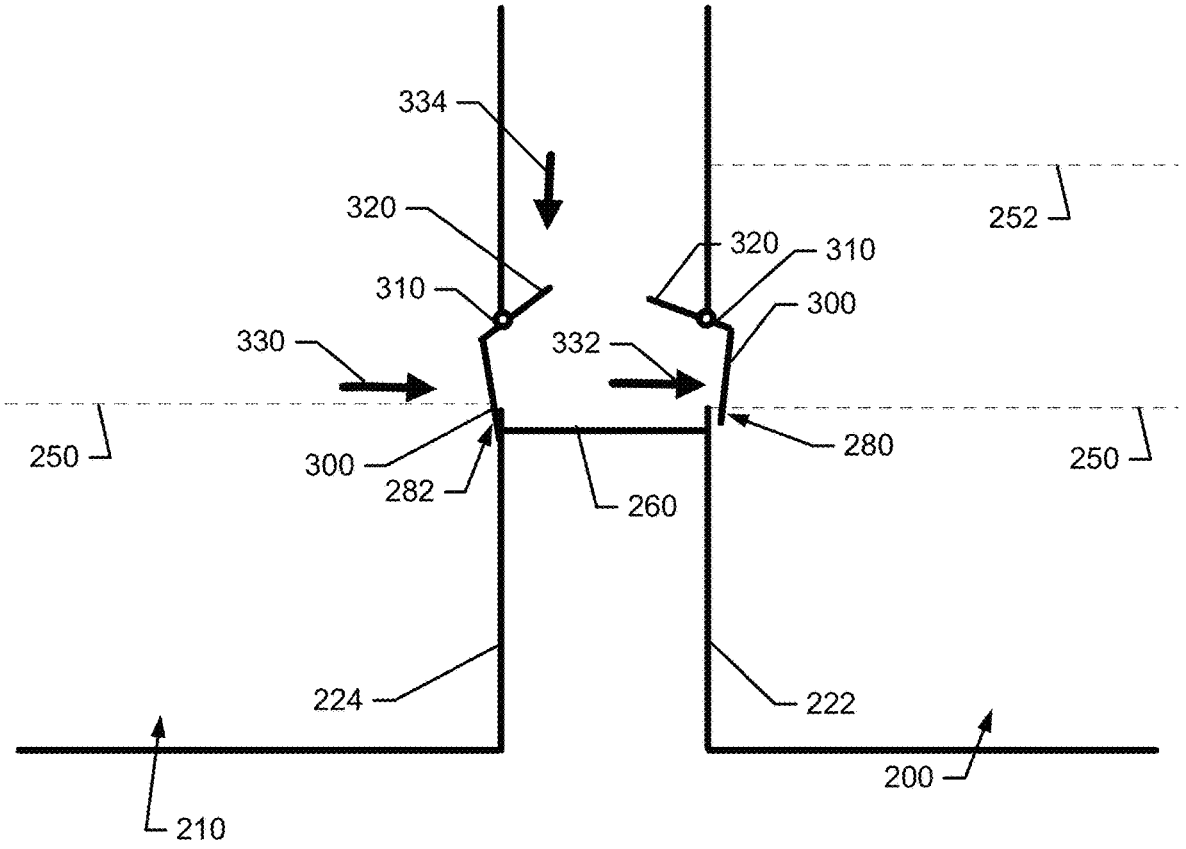
FIG. 3 illustrates a closer view of the filling chamber and filling gates of the multi-chambered degas bottle in accordance with an example embodiment.

FIG. 3 illustrates a close up view of the first and second connection passages 270 and 272 and the first and second filling gates 280 and 282 to facilitate further discussion of the structures and operation of the first and second filling gates 280 and 282. In this regard, the second filling gate 282 is shown in the closed position, and the first filling gate 280 is shown rotated to the open position. Notably, in some cases, it may be expected that the first and second filling gates 280 and 282 generally remain synchronized (i.e., both open or both closed). However, it is possible that one could be opened while the other is closed. Regardless, FIG. 3 is provided to explain operation instead of show any particular state.

The first and second filling gates 280 and 282 may each be defined by a seal portion 300 (or seating surface), a hinge portion 310 and an activator portion 320. The seal portion 300 may, when fully seated against the first and second connection passages 270 and 272, be in the closed position, thereby preventing flow in the direction of arrow 330 from the second chamber 210 into the filling chamber 220. The second filling gate 282 is shown in the closed position in FIG. 3. When the cooling fluid is provided into the filling chamber 220 and the level of the second chamber 210 (or first chamber 210) is less than the fill level 250, pressure in the filling chamber 220 may push in the direction of arrow 332 to pivot the seal portion 300 (also in the direction of arrow 332) about the hinge portion 310 to the opened position shown for the first filling gate 280 in FIG. 3. Of note, a downward force (shown by arrow 334) exerted on the top of the activator portion 320 may also cause the first filling gate 280 to transition to the opened position shown in FIG. 3. In some cases, a tool designed to actuate or contact the activator portion 330 may be used in connection with filling. For example, such a tool may be used for initial filling at a manufacturing plant or in other initial filling situations.

In some embodiments, the activator portion 320 and the seal portion 300 may be angled relative to each other. For example, the activator portion 320 and the seal portion 300 may form an "L" shape therebetween. The hinge portion 310 may be disposed proximate to (although potentially not directly at) the intersection between the activator portion 320 and the seal portion 300. Moreover, the seal portion 300 may be longer and/or heavier than the activator portion 320 in order to enable gravity to bias the first and second filling gates 280 and 282 to the closed position, as mentioned above. The increased length and/or width of the seal portion 300 below the hinge portion 310 may cause the first and second filling gates 280 and 282 to be seated against the first and second connection passages 270 and 272 to prevent flow from the first and second chambers 200 and 210 into the filling chamber 220 both normally, and responsive to the level of cooling fluid in the first and second chambers 200 and 210 reaching (or exceeding) the fill level 250.

Figure 4:
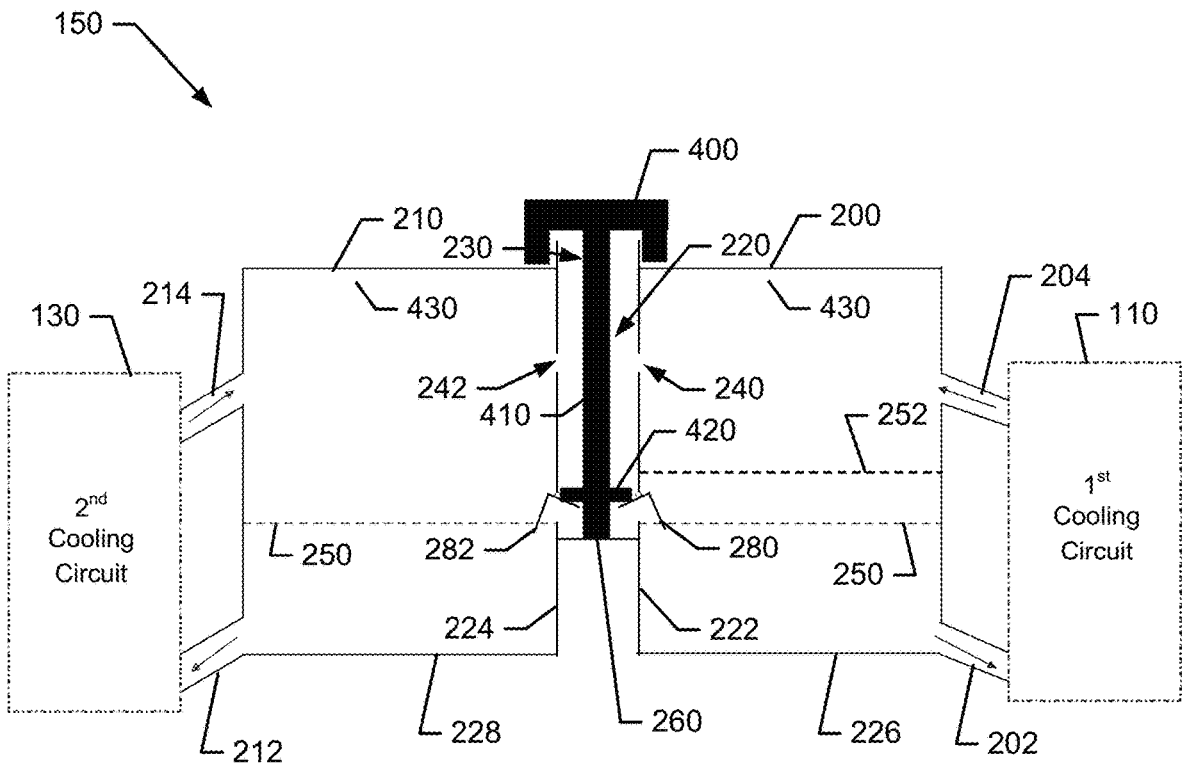
FIG. 4 shows a concept view of the degas bottle during an initial fill operation in accordance with an example embodiment.

FIG. 4. illustrates an example of an initial filling process in which a filling tool 400 is used to actuate the activator portion 330 of each of the first and second filling gates 280 and 282. As can be appreciated from FIG. 4, the cap 232 shown in FIG. 2 may be removed and the filling tool 400 may be inserted through the fill port 230 (or neck) into the filling chamber 220. In particular, the filling tool 400 may include a shaft 410 and an actuator portion 420 (e.g., a disc having a larger diameter than the shaft 410). The shaft 410 may fit between the activator portions 330 of the first and second filling gates 280 and 282, but the actuator portion 420 may not fit therebetween. Accordingly, when the filling tool 400 is inserted far enough for the actuator portion 420 of the filling tool 400 to contact the activator portions 330 of the first and second filling gates 280 and 282, the first and second filling gates 280 and 282 may be manually transitioned to (and held in) the opened position shown in FIG. 4.

In some embodiments, an initial filling process may include multiple stages. In this regard, for example, cooling fluid may be poured into the filling chamber 220 (either through the filling tool 400 or around sides thereof) until both the first and second chamber 200 and 210 are filled up to the neck (e.g., pressure filling) as shown by fill lines 430. In this case, the first and second air gates 240 and 242 may allow the cooling fluid to pass therethrough to even out the levels in the first and second chambers 200 and 210. The cooling fluid may be drawn through the first and second filling gates 280 and 282 as needed to fill each of the first and second cooling circuits 110 and 130, while maintaining a relatively even level and the second stage may include filling each of the first and second chambers 200 and 210 to the fill level 250 (after the first and second cooling circuits 110 and 130 have also filled). Thereafter, the filling tool 400 may be removed, and the state of the system may return to that which is shown in FIG. 2. As such, example embodiments may provide the filling tool 400 as an actuator configured to keep the first and second filling gates 280 and 282 open during the drawing down of the level to the fill level 250, which would otherwise not be achievable in the absence of an external force acting on the L-shaped gates (e.g., the activator portion 330 thereof). As a result, a plant fill-friendly process is defined that is also (after plant fill) designed to be used for common filling during servicing.

Figure 5:
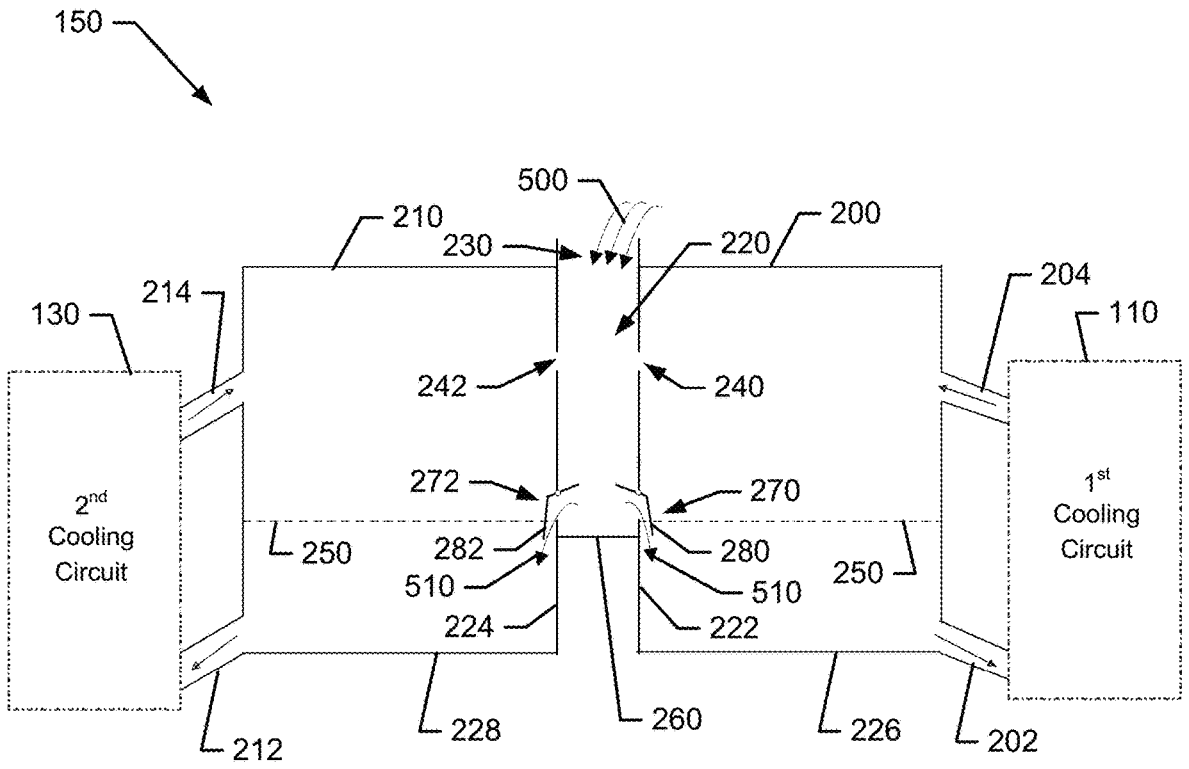
FIG. 5 illustrates a concept view of the degas bottle during a service fill operation in accordance with an example embodiment.

FIG. 5 illustrates a service fill in process in accordance with an example embodiment. For the service fill, the cap 232 of FIG. 2 is removed and the level of the cooling fluid in each of the first and second chambers 200 and 210 is expected to be below the fill level 250. A flow of cooling fluid 500 is provided into the filling chamber 220 via the fill port 230. Pressure builds up in the filling chamber 220 and pushes the first and second filling gates 280 and 282 to the opened position as shown in FIG. 5. A chamber filling flow 510 is established by each of the first and second filling gates 280 and 282 (through the first and second connection passages 270 and 272). The chamber filling flow 510 will continue until the first and second chamber 200 and 210 are filled to the fill level 250, at which point the level of cooling fluid in the first and second chamber 200 and 210, will naturally build up a pressure to close the first and second filling gates 280 and 282. The cap 232 may be installed and the system may revert to the condition shown in FIG. 2.

A vehicle cooling system may therefore be provided. The vehicle cooling system includes a first cooling circuit having a first operating temperature range when the vehicle is in an operational state, a second cooling circuit having a second operating temperature range, and a degas bottle. The degas bottle has a first chamber operably coupled to the first cooling circuit and a second chamber operably coupled to the second cooling circuit. The degas bottle includes a first chamber operably coupled to the first cooling circuit, a second chamber operably coupled to the second cooling circuit, and a third chamber configured as a common filling chamber for the first and second chambers. The first chamber is operably coupled to the third chamber via a first filling gate, and the second chamber is operably coupled to the third chamber via a second filling gate. The first and second filling gates are configured for simultaneous opening during a fill operation in which cooling fluid is provided into the third chamber to fill the first and second chambers.

The vehicle cooling system (or the degas bottle) of some embodiments may include additional features, modifications, augmentations and/or the like to achieve further objectives or enhance operation. The additional features, modifications, augmentations and/or the like may be added in any combination with each other. Below is a list of various additional features, modifications, and augmentations that can each be added individually or in any combination with each other. For example, the first and second filling gates may each comprise a seal portion, a hinge portion and an activator portion. The seal portion may be configured to seat against a connection passage separating the first chamber or the second chamber from the third chamber to prevent flow of the cooling fluid in a direction from the first or second chambers to the third chamber. In an example embodiment, the seal portion may be longer and/or heavier than the activator portion, and may be disposed below the hinge portion relative to the activator portion to bias the seal portion to a closed position via gravity. In some cases, the degas bottle may be configured to receive a filling tool during an initial fill operation. The fill tool may include a shaft extending through the third chamber toward the activator portion of each of the first and second filling gates. The fill tool may also include an actuator portion disposed on the shaft to contact the activator portion of the first and second filling gates and overcome the bias to hold the first and second filling gates in an opened position. In an example embodiment, the first chamber may include a first isolation wall and a first bottom wall. The second chamber may include a second isolation wall and a second bottom wall, while the first and second isolation walls face each other on opposing sides of the third chamber. A connection passage from each of the first and second chambers to the third chamber may pass through the first and second isolation walls, respectively. The third chamber may include a bottom wall disposed proximate to the connection passage of each of the first and second chambers. In some cases, a fill level of each of the first and second chambers may be proximate to the bottom wall of the third chamber. When the cooling fluid is provided in the third chamber, pressure buildup in the third chamber may open the first and second filling gates simultaneously until the cooling fluid reaches the fill level in each of the first and second chambers at which point the first and second filling gates close. In an example embodiment, the connection passage formed in each of the first and second isolation walls may be spaced apart equally from each of the first and second bottom walls. In some cases, when the first and second chambers are filled with the cooling fluid to the fill level, a level of the cooling fluid in the third chamber may be less than 5% of a height of the third chamber. In an example embodiment, the first and second filling gates each include a seal portion and a hinge portion. The seal portion may be configured to seat against a connection passage separating the first chamber or the second chamber from the third chamber to prevent flow of the cooling fluid in a direction from the first or second chambers to the third chamber. The hinge portion may be configured to define a hinge axis substantially parallel to a ground plane such that the seal portion pivots about the hinge axis to an opened position when a level of the cooling fluid is higher in the third chamber than the first and second chambers, and pivots about the hinge axis to a closed position when the level of the cooling fluid is lower in the third chamber than the first and second chambers.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A vehicle cooling system comprising:

a first cooling circuit having a first operating temperature range when the vehicle is in an operational state;

a second cooling circuit having a second operating temperature range when the vehicle is in the operational state, the first operating temperature range being higher than the second operating temperature range; and a degas bottle comprising a first chamber operably coupled to the first cooling circuit, a second chamber operably coupled to the second cooling circuit, and a third chamber configured as a common filling chamber for the first and second chambers, wherein the first chamber is operably coupled to the third chamber via a first filling gate, and the second chamber is operably coupled to the third chamber via a second filling gate, and wherein the first and second filling gates are configured for simultaneous opening during a fill operation in which cooling fluid is provided into the third chamber to fill the first and second chambers.

2. The vehicle cooling system of claim 1, wherein the first and second filling gates each comprise a seal portion, a hinge portion and an activator portion, and wherein the seal portion is configured to seat against a connection passage separating the first chamber or the second chamber from the third chamber to prevent flow of the cooling fluid in a direction from the first or second chambers to the third chamber.

3. The vehicle cooling system of claim 2, wherein the seal portion is longer and/or heavier than the activator portion, and disposed below the hinge portion relative to the activator portion to bias the seal portion to a closed position via gravity.

4. The vehicle cooling system of claim 3, wherein the degas bottle is configured to receive a filling tool during an initial fill operation, wherein the fill tool comprises a shaft extending through the third chamber toward the activator portion of each of the first and second filling gates, and wherein the fill tool comprises an actuator portion disposed on the shaft to contact the activator portion of the first and second filling gates and overcome the bias to hold the first and second filling gates in an opened position.

5. The vehicle cooling system of claim 1, wherein the first chamber comprises a first isolation wall and a first bottom wall, wherein the second chamber comprises a second isolation wall and a second bottom wall, wherein a connection passage from each of the first and second chambers to the third chamber passes through the first and second isolation walls, respectively, and wherein the third chamber comprises a bottom wall disposed proximate to the connection passage of each of the first and second chambers.

6. The vehicle cooling system of claim 5, wherein a fill level of each of the first and second chambers is proximate to the bottom wall of the third chamber, wherein, when the cooling fluid is provided in the third chamber, pressure buildup in the third chamber opens the first and second filling gates simultaneously until the cooling fluid reaches the fill level in each of the first and second chambers at which point the first and second filling gates close.

7. The vehicle cooling system of claim 6, wherein the connection passage formed in each of the first and second isolation walls is spaced apart equally from each of the first and second bottom walls.

8. The vehicle cooling system of claim 6, wherein, when the first and second chambers are filled with the cooling fluid to the fill level, a level of the cooling fluid in the third chamber is less than 5% of a height of the third chamber.

9. The vehicle cooling system of claim 1, wherein the first and second filling gates each comprise a seal portion and a hinge portion, wherein the seal portion is configured to seat against a connection passage separating the first chamber or the second chamber from the third chamber to prevent flow of the cooling fluid in a direction from the first or second chambers to the third chamber, and wherein the hinge portion is configured to define a hinge axis substantially parallel to a ground plane and the seal portion pivots about the hinge axis to an opened position when a level of the cooling fluid is higher in the third chamber than the first and second chambers, and pivots about the hinge axis to a closed position when the level of the cooling fluid is lower in the third chamber than the first and second chambers.

10. A multi-chambered degas bottle for a vehicle cooling system comprising a first cooling circuit having a first operating temperature range when the vehicle is in an operational state, and a second cooling circuit having a second operating temperature range when the vehicle is in the operational state, the first operating temperature range being higher than the second operating temperature range, the multi-chambered degas bottle comprising:

a first chamber operably coupled to the first cooling circuit;

a second chamber operably coupled to the second cooling circuit; and a third chamber configured as a common filling chamber for the first and second chambers, wherein the first chamber is operably coupled to the third chamber via a first filling gate, and the second chamber is operably coupled to the third chamber via a second filling gate, and wherein the first and second filling gates are configured for simultaneous opening during a fill operation in which cooling fluid is provided into the third chamber to fill the first and second chambers.

11. The multi-chambered degas bottle of claim 10, wherein the first and second filling gates each comprise a seal portion, a hinge portion and an activator portion, and wherein the seal portion is configured to seat against a connection passage separating the first chamber or the second chamber from the third chamber to prevent flow of the cooling fluid in a direction from the first or second chambers to the third chamber.

12. The multi-chambered degas bottle of claim 11, wherein the seal portion is longer and/or heavier than the activator portion, and disposed below the hinge portion relative to the activator portion to bias the seal portion to a closed position via gravity.

13. The multi-chambered degas bottle of claim 12, wherein the degas bottle is configured to receive a filling tool during an initial fill operation, wherein the fill tool comprises a shaft extending through the third chamber toward the activator portion of each of the first and second filling gates, and wherein the fill tool comprises an actuator portion disposed on the shaft to contact the activator portion of the first and second filling gates and overcome the bias to hold the first and second filling gates in an opened position.

14. The multi-chambered degas bottle of claim 10, wherein the first chamber comprises a first isolation wall and a first bottom wall, wherein the second chamber comprises a second isolation wall and a second bottom wall, the first and second isolation walls facing each other on opposing sides of the third chamber, wherein a connection passage from each of the first and second chambers to the third chamber passes through the first and second isolation walls, respectively, and wherein the third chamber comprises a bottom wall disposed proximate to the connection passage of each of the first and second chambers.

15. The multi-chambered degas bottle of claim 14, wherein a fill level of each of the first and second chambers is proximate to the bottom wall of the third chamber, wherein, when the cooling fluid is provided in the third chamber, pressure buildup in the third chamber opens the first and second filling gates simultaneously until the cooling fluid reaches the fill level in each of the first and second chambers at which point the first and second filling gates close.

16. The multi-chambered degas bottle of claim 15, wherein the connection passage formed in each of the first and second isolation walls is spaced apart equally from each of the first and second bottom walls.

17. The multi-chambered degas bottle of claim 15, wherein, when the first and second chambers are filled with the cooling fluid to the fill level, a level of the cooling fluid in the third chamber is less than 5% of a height of the third chamber.

18. The multi-chambered degas bottle of claim 10, wherein the first and second filling gates each comprise a seal portion and a hinge portion, wherein the seal portion is configured to seat against a connection passage separating the first chamber or the second chamber from the third chamber to prevent flow of the cooling fluid in a direction from the first or second chambers to the third chamber, and wherein the hinge portion is configured to define a hinge axis substantially parallel to a ground plane and the seal portion pivots about the hinge axis to an opened position when a level of the cooling fluid is higher in the third chamber than the first and second chambers, and pivots about the hinge axis to a closed position when the level of the cooling fluid is lower in the third chamber than the first and second chambers.

19. A vehicle cooling system comprising:

a first cooling circuit having a first operating temperature range when the vehicle is in an operational state;

a second cooling circuit having a second operating temperature range when the vehicle is in the operational state, the first operating temperature range being higher than the second operating temperature range; and a degas bottle comprising a first chamber operably coupled to the first cooling circuit, a second chamber operably coupled to the second cooling circuit, and a third chamber configured as a common filling chamber for the first and second chambers, wherein the first chamber is operably coupled to the third chamber via a first filling gate, and the second chamber is operably coupled to the third chamber via a second filling gate, and wherein the first and second filling gates are biased to a closed position such that the third chamber empties into the first and second chambers during a fill operation and remains substantially empty of cooling fluid in the operational state when a fill level for the cooling fluid in each of the first and second chambers higher than a bottom wall of the third chamber.

20. The vehicle cooling system of claim 19, wherein the first and second filling gates each comprise a seal portion and a hinge portion, wherein the seal portion is configured to seat against a connection passage separating the first chamber or the second chamber from the third chamber to prevent flow of the cooling fluid in a direction from the first or second chambers to the third chamber, and wherein the hinge portion is configured to define a hinge axis substantially parallel to a ground plane and the seal portion pivots about the hinge axis to an opened position when a level of the cooling fluid is higher in the third chamber than the first and second chambers, and pivots about the hinge axis to a closed position when the level of the cooling fluid is lower in the third chamber than the first and second chambers.

* * * * *